US007219485B2

(12) United States Patent
Battisti

(10) Patent No.: US 7,219,485 B2
(45) Date of Patent: May 22, 2007

(54) SEMI-AUTOMATIC BOXING MACHINE

(75) Inventor: Antonio Battisti, Latina (IT)

(73) Assignee: Packservice S.r.l., Latina (IT)

( * ) Notice: Subject to any disclaimer, the term of this patent is extended or adjusted under 35 U.S.C. 154(b) by 29 days.

(21) Appl. No.: 11/141,219

(22) Filed: May 31, 2005

(65) Prior Publication Data

US 2005/0262814 A1 Dec. 1, 2005

(30) Foreign Application Priority Data

May 31, 2004 (IT) ..... BO2004A0347

(51) Int. Cl.
*B65B 35/30* (2006.01)

(52) U.S. Cl. ..... 53/542; 53/448; 198/418.5

(58) Field of Classification Search ..... 53/540, 53/543, 564, 566, 244, 250, 251, 542, 448; 198/418.5, 431

See application file for complete search history.

(56) References Cited

U.S. PATENT DOCUMENTS

| | | | | |
|---|---|---|---|---|
| 3,555,770 A | | 1/1971 | Rowekamp | |
| 3,753,509 A | | 8/1973 | Kock | |
| 3,984,964 A | * | 10/1976 | Stoll | 53/543 |
| 4,213,285 A | | 7/1980 | Mancini | |
| 4,662,150 A | * | 5/1987 | Johnson et al. | 53/458 |
| 4,864,801 A | * | 9/1989 | Fallas | 53/446 |
| 5,393,291 A | * | 2/1995 | Wingerter | 493/116 |
| 5,622,031 A | * | 4/1997 | Meives | 53/473 |
| 5,727,365 A | * | 3/1998 | Lashyro et al. | 53/448 |
| 5,732,536 A | * | 3/1998 | Lin et al. | 53/535 |
| 6,164,045 A | * | 12/2000 | Focke et al. | 53/543 |
| 6,959,525 B2 | * | 11/2005 | Prakken | 53/447 |

FOREIGN PATENT DOCUMENTS

| | | |
|---|---|---|
| DE | 2457961 | 6/1976 |
| DE | 29807325 | 10/1999 |
| EP | 0253229 | 1/1988 |

* cited by examiner

*Primary Examiner*—Rinaldi I. Rada
*Assistant Examiner*—Paul Durand
(74) *Attorney, Agent, or Firm*—William J. Sapone; Coleman Sudol Sapone P.C.

(57) ABSTRACT

In a semiautomatic boxing machine, a first conveyor receives and moves a plurality of erected boxes to a work station, while a second conveyor receives and moves a plurality of products to a station for forming groups of products. A manipulator picks up groups of products in the forming station and release them into corresponding boxes dwelling in the work station.

8 Claims, 3 Drawing Sheets

SEMI-AUTOMATIC BOXING MACHINE

FIELD OF THE INVENTION

The present invention relates to packaging of products, with a particular reference to a semiautomatic boxing machine.

DESCRIPTION OF THE PRIOR ART

The semiautomatic boxing machines are fed manually by an operator, who previously erects the blanks to obtain the boxes.

Generally, the operator folds the lower flaps of each blank, so as to close the bottom of a carton, leaving the upper flaps open, substantially spread out, to allow introduction of products.

At the inlet of the boxing machines, the so obtained boxes, open in the upper part and with the closed bottom are positioned on a first conveying belt.

The latter cooperates with associated means for automatic taping of the box lower flaps, in closing configuration.

The first conveying belt feeds a work station, in which the boxes are turned laterally by 90°, so as to turn their openings facing the groups of products defined in a corresponding piling station.

The piling station is fed continuously by a second conveying belt, situated parallel to the first belt, near thereto, and conveying products to be introduced into boxes.

Generally, the piling station cooperates with means, usually frusto-pyramidal means, which keep spread out the closing flaps of the turned boxes, and guide the groups of piled up products during the introduction thereof into the boxes.

The groups of products are moved into the turned boxes by suitable pusher means, cooperating with the frusto-pyramidal means.

When the filling is completed, the boxes are turned again by an angle of 90°, in order to be brought back to their initial configuration, with the openings oriented upwards, then moved away toward the outlet of the boxing machine by the first conveying belt.

At the outlet, the operator folds manually the upper flaps of the boxes, and possibly applies tape to them, so as to complete the boxes closing.

In many cases the products require a particular orientation inside the boxes, as it often happens with the bottles, which must be positioned with the closing caps turned toward the upper flaps, thus directly accessible to the operator or the user.

In this case, the forming station has means for turning the bottles, fed vertically by the second conveying belt, by a substantially right angle, in order to allow a correct orientation before their introduction into the boxes.

The versatility of the boxing machines of the prior art is extremely limited and they are characterized by a particularly reduced flexibility during the boxes filling, allowing only the introduction of pre-stratified and pre-piled up products, which results in serious instability of the latter during the transferring inside the boxes.

Moreover, it is very difficult to treat the products, which require a particular orientation inside the boxes, in particular in case of bottles, which must be positioned with the closing caps turned toward the upper flaps of the boxes.

In most cases, the frusto-pyramidal guiding means, associated to the forming station, are necessary to the correct and safe filling of the boxes, and to prevent the products from interfering with the closing flaps.

Another drawback of the prior art machines lies undoubtedly in the presence at the work station of means for a first lateral turning of the boxes, so as to allow the filling of the latter, and for a second turning, with which the filled boxes are brought back to their original orientation, that is with the opening turned upwards.

The second turning is particularly difficult, because the stability of the products inside the boxes is not assured, which results in all the disadvantages connected to a probable going out or displacement of the products.

Moreover, the above turnings reduce strongly the machines production rate, prolonging the boxing time.

Further, it is difficult to use the semiautomatic boxing machines of the prior art for packaging particular types of products.

SUMMARY OF THE INVENTION

The object of the present invention is to avoid the above mentioned drawbacks by proposing a semiautomatic boxing machine, which assures high versatility and flexibility standards during the boxes filling, independently from the type of the treated products.

Another object of the present invention is to propose an extremely compact and strong machine, which allows an utmost reduction of the components and the corresponding maintenance and installation steps, and which assures high production rate in any operation conditions.

A further object of the present invention is to propose a machine, which assures the correct filling of the boxes, preventing any interfering and going out of the products during the introduction step.

The above mentioned objects are obtained, in accordance with the contents of the claims, by a semiautomatic boxing machine for inserting products into erected boxes having lower flaps folded to define a closed bottom, and with upper flaps substantially spread out and oriented upwards, so as to define an inlet section for the introduction of the products, the machine including:

first conveying means for receiving and moving a plurality of said erected boxes, substantially aligned;

a work station situated along the conveyor means;

second conveying means for receiving and moving a plurality of products;

a station situated along said second conveying means for forming groups of products;

manipulating means operated in step relation with said first and second conveying means to pick up groups of products situated in said forming station and to release them into boxes dwelling in said work station.

BRIEF DESCRIPTION OF THE DRAWINGS

The characteristic features of the invention will be pointed out in the following description of some preferred but not limited embodiments, with reference to the enclosed figures, in which.

DISCLOSURE OF THE PREFERRED EMBODIMENT

Figure 3:
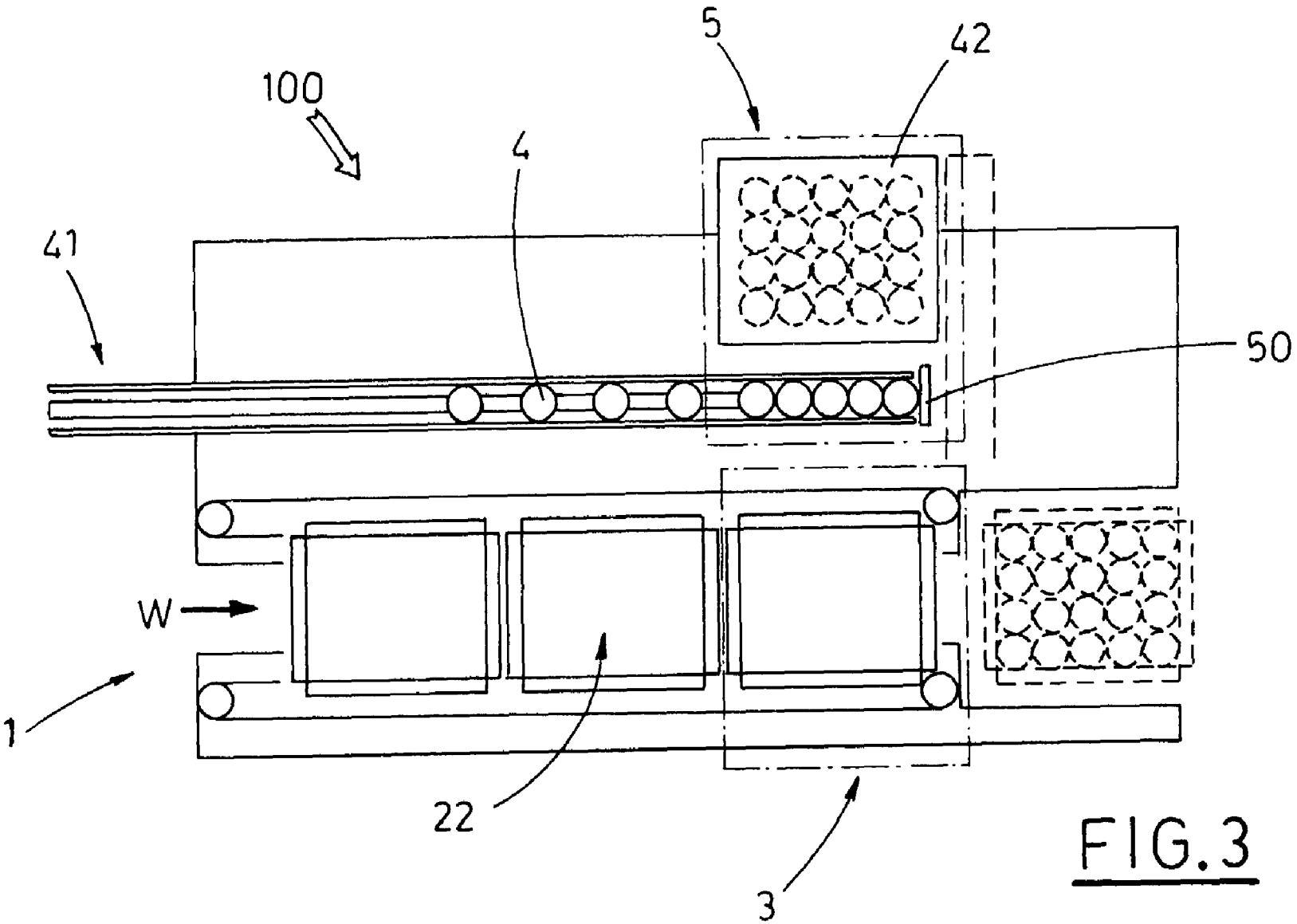
Figure 5:
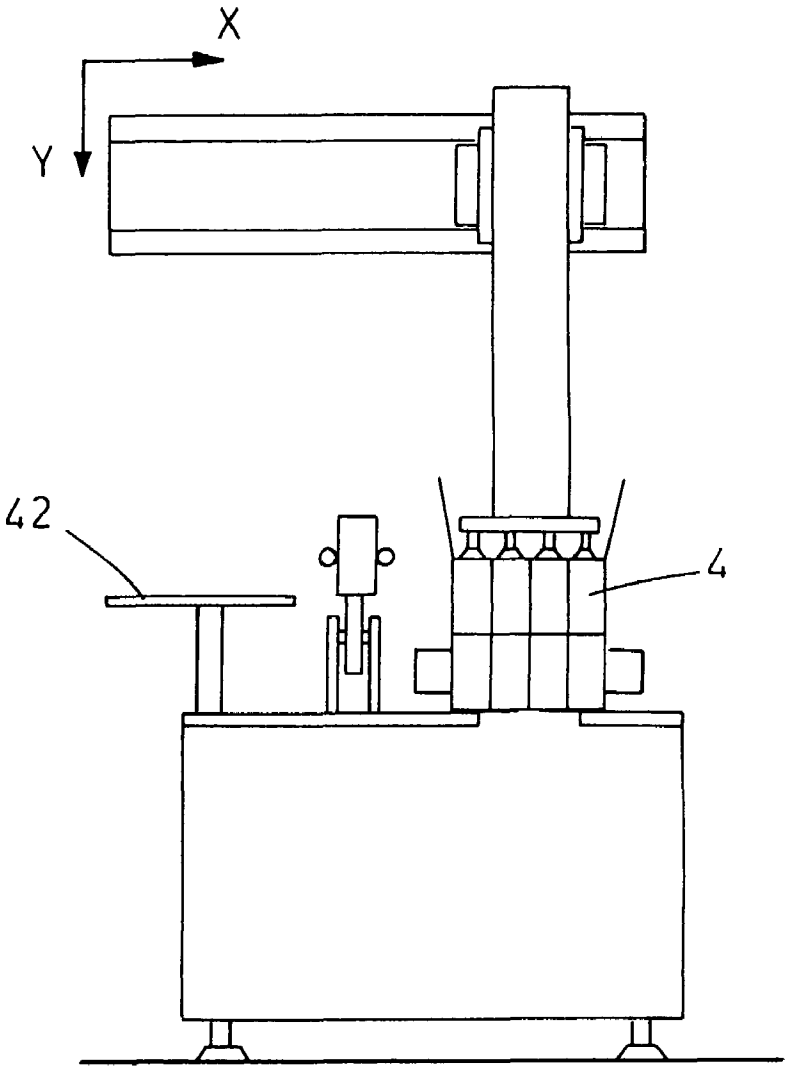
FIGS. 4 and 5 are schematic, relative front view of the boxing machine in subsequent working steps.

Regards the above drawings, the general reference number 100 indicates the proposed semiautomatic boxing machine, which includes a first conveying belt 1, receiving a plurality of erected blanks, substantially aligned boxes 2, and moving the latter to a work station 3 (FIG. 3).

Each box 2 is erected with its lower flaps folded, to define a closed bottom, and with its upper flaps 20 spread out and turned upwards, so as to define an inlet mouth 22 for the introduction of products 4.

In case of semiautomatic boxing machines, the blanks are erected manually by an operator, before their positioning on the first conveying belt 1.

Means 17 for taping the lower flaps of each box 2 are situated below the first conveying belt 1.

The proposed boxing machine 100 has also a second conveying belt 41, preferably operated continuously to receive a plurality of products 4 and moving the latter toward a station 5 for forming groups of products 4.

For example, the conveying belts, first 1 and second 41, are situated substantially coplanar and operated in the same feeding direction W (FIG. 3).

The proposed boxing machine 100 has also manipulating means 6 for picking up groups of products 4 positioned in the forming station 5 and releasing them into corresponding boxes 2, dwelling in the work station 3.

The manipulating means 6 are preferably operated, in step relation with the conveying belts 1, 41, along the cartesian axes X, Y, orthogonal to the feeding direction W of the belts 1, 41.

The forming station 5, advantageously situated beside the work station 3, includes abutment means 50, connected to the second conveying belt 41, e.g. near its terminal portion, so as to define, by abutment, a series of rows of products 4 on the second conveying belt 41.

Advantageously, the forming station 5 includes also a storage plate 42, situated near the second conveying belt 41, beside it and substantially coplanar therewith, for receiving products 4 picked up by the manipulating means 6, from the second conveying belt 41, preferably near the abutment means 50.

For example, the second conveying belt 41 is situated laterally with respect to the storage plate 42, in particular, it is situated between the storage plate 42 and the first conveying belt 1.

The operation of the proposed machine, as easily understood, will be described in the following.

The first conveying belt 1 allows each empty box 2 to dwell in the work station 3, until it is filled to a desired degree, partially or completely.

The second conveying belt 41, operated continuously, brings the products 4 to abut against the abutment means 50, so as to define a series of products 4 (FIG. 3).

Figure 2:
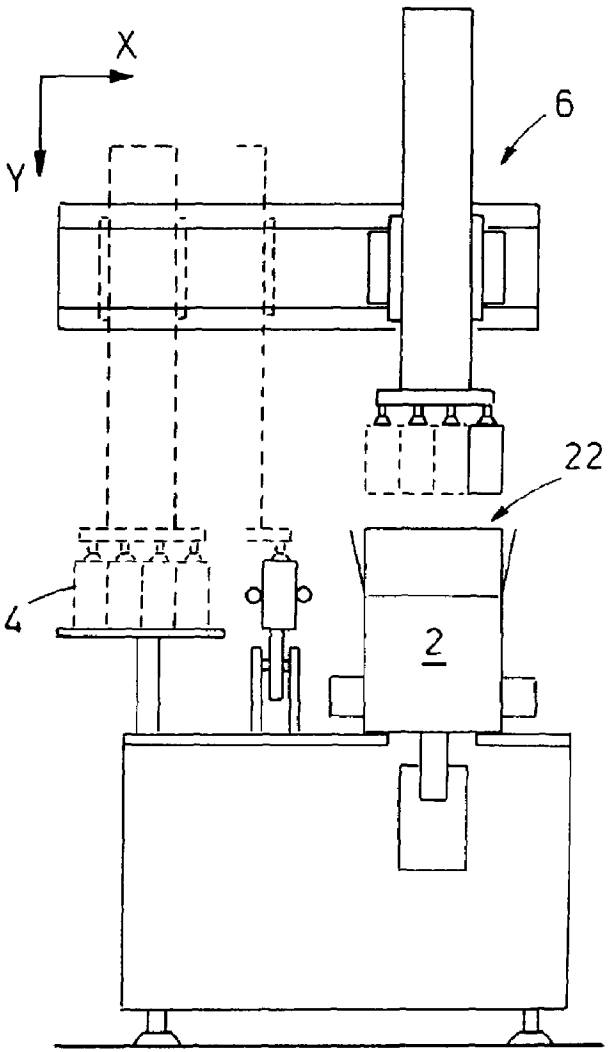
FIGS. 1, 2, 3 are schematic, respectively lateral, front and top views of the proposed semiautomatic boxing machine.
Figure 1:
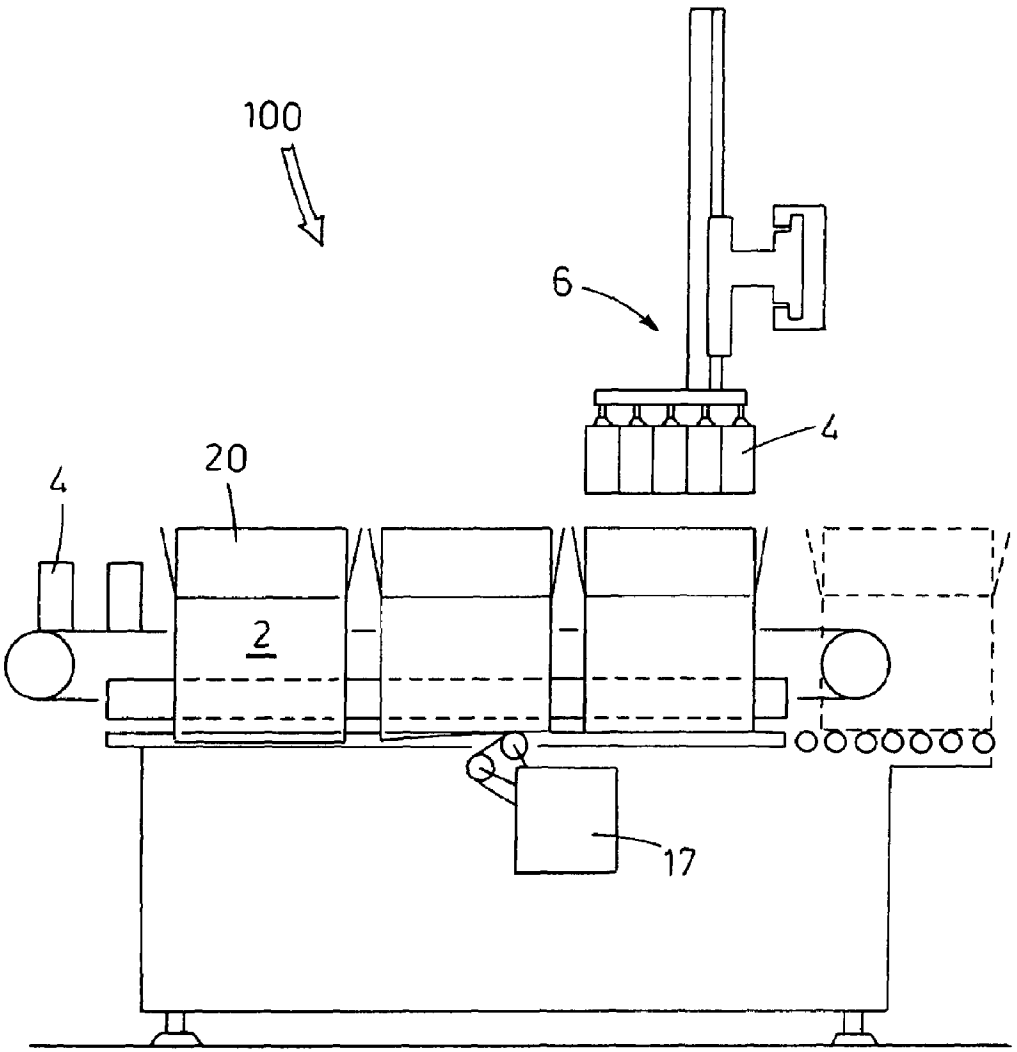

As soon as the formation of the row of products 4 against the abutment means 50 is completed, the manipulating means 6 are first operated along the first Cartesian axis Y, in order to pick up the row, and then, the manipulating means 6 are operated along the second Cartesian axis X, in order to position, due to a further operation of the manipulating means 6 along the first Cartesian axis Y, the row of products into the box 2, or onto the storage plate 42, in function of the production specifics (FIGS. 2, 3).

Consequently, the manipulating means 6 can proceed, picking up the rows of products 4, which are formed periodically on the second conveying belt 41, to put them into the box 2, dwelling in the work station 3, until the layer is completed, or to put them onto the storage plate 42, until the layer is completed.

In the last case, the manipulating means 6 can pick up one or more rows of products 4 situated on the storage plate 42 and release them into the box 2, or they can pick up the whole layer of products 4, formed previously.

Figure 4:
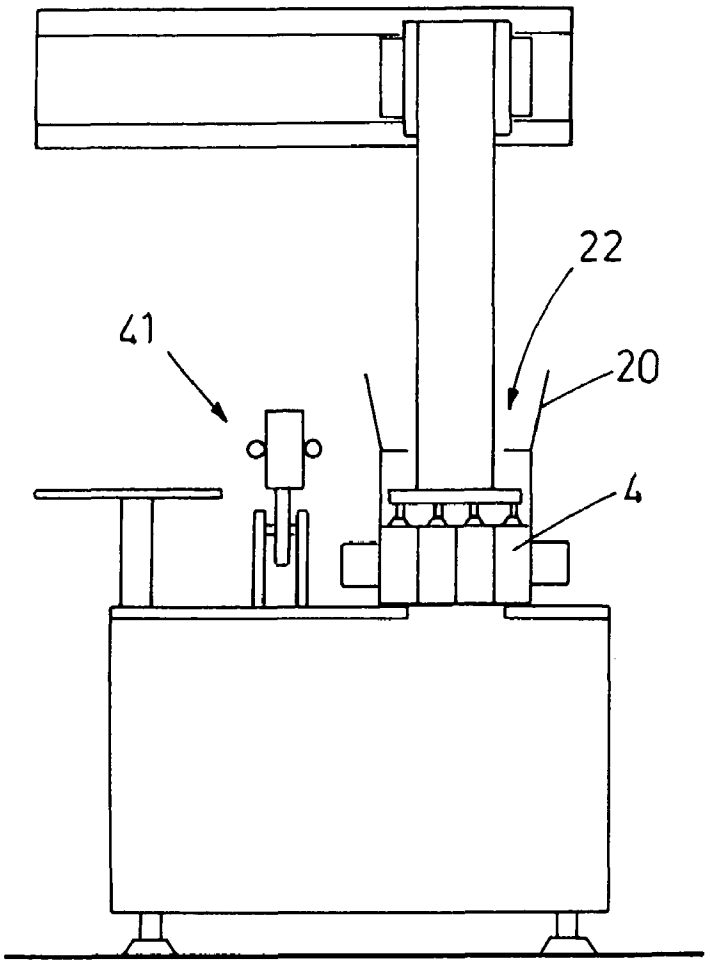

In most cases, the filling of the box 2 includes the introduction of one or more layers of products 4 (FIG. 4, 5).

As soon as the box 2 is filled, the first conveying belt 1 conveys it toward the outlet of the boxing machine 100, to allow the operator to fold manually the upper flaps and tape them, so as to complete the closing of the box 2.

Consequently, a new empty box 2 is situated in the work station 3, waiting for the preset filling cycle.

It is easy to understand from the above description, that the proposed boxing machine assures high versatility and flexibility standards during the boxes filling, independently from the type of the treated products.

Actually, the groups of products to be introduced, can include only one row, or a series of rows, or even a complete layer, depending on the specifics.

This is possible due to the presence of the storage plate, which allows to accumulate products, or to form a transitory magazine thereof.

Thanks to the innovating way of filling the boxes, assured by a manipulator with two Cartesian axes X, Y, it is possible to handle, in a versatile way, also bottles, without the necessity to turning them first in the forming station, as it occurs in prior art.

What above avoids any hindrance and going out of the products during the introduction into the boxes.

The boxing machine proposed by the present invention is extremely compact and strong, and allows un utmost reduction of the number of components and corresponding maintenance and installation steps, and it assures high productivity in any working conditions.

Actually, the proposed machine does not include the most relevant feature of the prior art machines, that is it does not have the means for overturning the bottles, or the means for overturning the boxes, together with the frusto-pyramidal guiding means for facilitating the boxes filling.

It is understood that the proposed invention has been described, with reference to the enclosed figures, as a mere, not limiting example. Therefore, it is obvious that any changes or variants applied thereto remain within the protective scope defined by the following claims.

What is claimed is:

1. A semiautomatic boxing machine for inserting products into erected boxes having lower flaps folded to define a closed bottom, and having upper flaps substantially spread out and oriented upwards, so as to define an inlet section for the introduction of the products, the machine comprising:

first conveying means for receiving and moving a plurality of substantially aligned erected boxes in a feeding direction;

a work station situated along said first conveying means, the first conveying means being operated to allow each of said erected boxes to dwell in said work station for a time sufficient to be filled;

second conveying means for receiving and moving a plurality of products;

abutment means connected to said second conveying means near a terminal portion thereof, said second conveying means conveying said products toward said abutment means for forming a row of products against the abutment means;

a storage plate, situated beside said second conveying means;

manipulating means displaceable above said first and second conveying means and above said storage plate, said manipulating means being operated in step relation with said first and second conveying means for being positioned above said row of products formed on the second conveying means against said abutments means, the manipulating means picking up the row of products from the second conveying means, as the second conveying means continue to operate for forming additional rows of products against said abutment means as each previously formed row is picked up, the manipulating means either placing each row of products picked up into an erected box dwelling in said work station to form a group of products therein, or placing each row of products onto said storage plate until a group of products is formed thereon, the manipulating means then transferring the group of products from the storage plate to an erected box dwelling in said work station.

2. The machine, as claimed in claim 1, wherein said first conveying means and said second conveying means are operated in the same feeding direction.

3. The machine, as claimed in claim 2, wherein said manipulating means are operated along cartesian axes, substantially orthogonal to said feeding direction.

4. The machine, as claimed in claim 1, wherein said group of products formed in the erected box or on the storage plate comprises at least one layer of products.

5. The machine, as claimed in claim 1, further comprising means connected to a lower part of said first conveying means for applying tape to the folded lower flaps.

6. The machine, as claimed in claim 1, wherein said work station and said abutment means are situated beside each other.

7. The machine, as claimed in claim 1, wherein said second conveying means are situated between said storage plate and said first conveying means.

8. The machine, as claimed in claim 1, wherein said first and second conveying means are situated coplanar to each other.

* * * * *